US009635917B2

(12) United States Patent
Whitley et al.

(10) Patent No.: US 9,635,917 B2
(45) Date of Patent: May 2, 2017

(54) DEVICE, SYSTEMS, AND METHODS FOR HOLDING OBJECTS

(71) Applicant: Triple BBB's, LLC, Hickory, NC (US)

(72) Inventors: Kimberly H. Whitley, Hickory, NC (US); Adele C. McLean, Chapel Hill, NC (US); Wendy S. Hill, Raleigh, NC (US); Aly Khalifa, Raleigh, NC (US); Jennafer Pettit, Raleigh, NC (US)

(73) Assignee: Triple BBB's, LLC, Hickory, NC (US)

( * ) Notice: Subject to any disclaimer, the term of this patent is extended or adjusted under 35 U.S.C. 154(b) by 0 days.

(21) Appl. No.: 15/070,784

(22) Filed: Mar. 15, 2016

(65) Prior Publication Data

US 2016/0192754 A1 Jul. 7, 2016

Related U.S. Application Data

(63) Continuation of application No. 14/530,287, filed on Oct. 31, 2014, now Pat. No. 9,314,079.

(60) Provisional application No. 61/898,970, filed on Nov. 1, 2013.

(51) Int. Cl.

| | |
|---|---|
| ***A45C 13/02*** | (2006.01) |
| ***A45C 11/16*** | (2006.01) |
| ***A45C 13/10*** | (2006.01) |

(52) U.S. Cl.

CPC ..... *A45C 13/02* (2013.01); *A45C 11/16* (2013.01); *A45C 13/10* (2013.01); *A45C 2013/026* (2013.01); *A45C 2013/1015* (2013.01)

(58) Field of Classification Search

CPC ..... A45C 13/02; A45C 13/10; A45C 11/16; A45C 2013/026; A45C 2013/1015

USPC ..... 220/529, 530, 531, 532, 533, 534, 535, 220/554, 528

See application file for complete search history.

(56) References Cited

U.S. PATENT DOCUMENTS

| | | | | |
|---|---|---|---|---|
| 4,274,537 | A * | 6/1981 | Cooper | B42F 5/00 206/472 |
| 4,720,012 | A | 1/1988 | Dufour | |
| 4,735,246 | A | 4/1988 | Niehaus | |
| 4,760,920 | A | 8/1988 | Thomsen | |
| 4,787,488 | A | 11/1988 | Campanini | |
| 4,848,585 | A | 7/1989 | Snyder | |
| 5,069,332 | A | 12/1991 | Williams et al. | |

(Continued)

OTHER PUBLICATIONS

"Slim and Flat Jewelry Case" http://www.amazon.com/dp/B0039NH6YS/ref=asc_df_B0039NH6YS1718924?smid=ACT0VSSANPHJ8&tag=shopzilla_mp_131720&linkCode=asn&creative=395105&creativeASIN=B0039NH6YS.

(Continued)

*Primary Examiner* — Robert J Hicks
*Assistant Examiner* — Kareen Thomas
(74) *Attorney, Agent, or Firm* — Bookoff McAndrews, PLLC

(57) ABSTRACT

Provided is a system for storing items, having a storage device with a base portion and a lid portion. The system also may include one or more movable inserts configured for disposal in the storage device. The one or more movable inserts may be configured for disposal in the storage device and may have a surface having one or more first fastening elements. The system also may include a holder configured to be removably attached to an insert. The holder may have a surface having one or more second fastening elements configured to engage the one or more first fastening elements, and configured to hold the items on the surface of the insert.

12 Claims, 10 Drawing Sheets

(56) References Cited

U.S. PATENT DOCUMENTS

| | | | | | |
|---|---|---|---|---|---|
| 5,240,120 | A * | 8/1993 | McDonough | A47F 7/02 206/495 |
| 5,617,948 | A | 4/1997 | Rainey | |
| 5,620,271 | A * | 4/1997 | Bergh | B42F 5/005 206/307 |
| 5,642,817 | A | 7/1997 | O'Brien | |
| 5,984,092 | A | 11/1999 | Heard-Willmon | |
| 6,523,653 | B2 | 2/2003 | Roegner | |
| 6,959,806 | B2 | 11/2005 | Barker | |
| D543,120 | S * | 5/2007 | Coe | D9/732 |
| 7,673,744 | B1 | 3/2010 | Henderson | |
| 7,731,023 | B1 | 6/2010 | Lesch | |
| 2004/0168938 | A1 | 9/2004 | Bergh | |
| 2012/0091018 | A1 * | 4/2012 | Bock | B42F 7/065 206/307 |

OTHER PUBLICATIONS

"Blitz Hot Pink Faux Crocodile Jewelry Organizer" http://www.ebay.com/itm/Blitz-Hot-Pink-Faux-Crocodile-Jewelry-Organizer-/280530769976?pt=LH_DefaultDomain_0&hash==item4150efd838.

"Stella & Dot Jewelry Travel Case—Navy." http://www.thisnext.com/tag/travel-cases/.

Screenshot from Amazon.com, "The Gentle Jewelry Case Womens [sic] Jewelry Organizer Travel Case Luggage Organizer (Zebra Print)" by Gentle Jewelry Case, last accessed on Sep. 6, 2015.

* cited by examiner

DEVICE, SYSTEMS, AND METHODS FOR HOLDING OBJECTS

CROSS-REFERENCE TO RELATED APPLICATIONS

This application is a Continuation of U.S. application Ser. No. 14/530,287, filed on Oct. 31, 2014, now U.S. Pat. No. 9,314,079, which claims the benefit of priority from U.S. Provisional Application No. 61/898,970, filed on Nov. 1, 2013, the entireties of all of which are incorporated herein by reference.

TECHNICAL FIELD

The present disclosure generally relates to systems, device, and method for safely storing objects. More specifically, the present disclosure relates to storing and organizing fragile items such as jewelry, cosmetics, arts and crafts tools, etc.

BACKGROUND

Fragile items such as jewelry are often stored in individual containers, making it difficult to locate and keep track of multiple items. Such conventional containers do not allow efficient organization and easy access. Accordingly, a need exists for systems and devices that provide for secure and organized storage and movement of items for easy access, identification, and selection.

SUMMARY

Embodiments of the present disclosure relate to, among other things, devices, systems, and methods for securely storing and organizing fragile objects. Each of the embodiments disclosed herein may include one or more of the features described in connection with any of the other disclosed embodiments.

In one embodiment, a system for storing items may include a storage device having a base portion and a lid portion and one or more movable inserts configured for disposal in the storage device. The one or more inserts may include a surface comprising one or more first fastening elements, and a holder configured to be removably attached to an insert. The holder member may have a surface having one or more second fastening elements configured to engage the one or more first fastening elements and configured to hold items on the surface of the insert.

In another embodiment, an insert configured for disposal in a storage device may include a hinge portion configured to attach to a hinge portion of another insert and an attachment surface having an edge disposed within a top and bottom surface of the hinge portion. The attachment surface may include a first and second surface comprising one or more fastening elements.

In another embodiment, a system for storing items may include a plurality of inserts having a surface including a plurality of loops and a holder configured for removably connecting one of the plurality of inserts to another one of the plurality of inserts. The holder member may include a surface comprising a plurality of hooks and configured to hold the fragile items on the surface of the insert. In addition, the system may include a hanging member having a ring portion configured to attach to a protrusion, and an attachment portion for connecting to a portion of one of the plurality of inserts.

It is understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the present disclosure and together with the description, serve to explain the principles of the disclosure.

DETAILED DESCRIPTION

Overview

Figure 1:
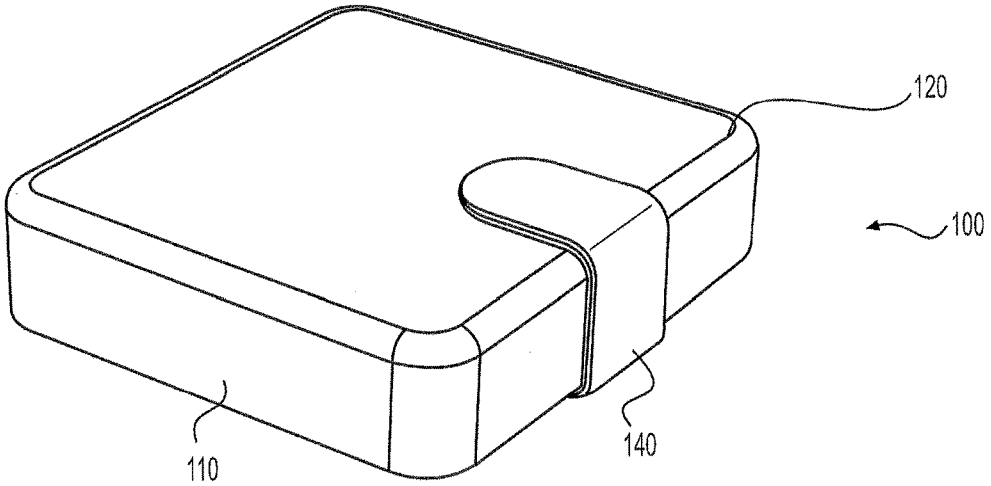
FIG. 1 is a perspective view illustration of a storage device in a closed configuration, according to an exemplary embodiment of the present disclosure.

The present disclosure is drawn to systems for securely storing and organizing fragile objects, such as jewelry, cosmetics, small tools, art and craft supplies, etc. A system according to one embodiment includes a plurality of inserts each having an attachment surface on which the fragile objects may be placed and secured by a holder. The holder may removably attach to the attachment surface to allow each access to the object. In some examples, the attachment surface may have a plurality of fabric loops, which may removably attach to a plurality of hooks on a back surface of the holder. Examples of such hook-and-loop fasteners include VELCRO™. However, it is to be understood that other suitable attaching or fastening elements or combinations of attaching/fastening elements may be used, such as reattachable/temporary adhesive, magnetic components, buttons, etc. The inserts may be placed in a storage device or container in a manner in which each insert may be securely held, easily viewed, and accessed. The storage device may include a lid or other form of cover to protect the objects placed on the inserts. In some examples, each insert may include a hinge portion, which may be attached for insertion into a spine of a storage device so that each insert in the storage device may be flipped through and the contents of each insert may be easily viewed. Each surface of the hinge portion may have a fastening element that may attach to the adjacent surface of an adjacent insert so that multiple hinge portions may be stacked and attached to each other. For example, a top surface of each hinge portion may include a plurality of hooks and a bottom surface may include a plurality of loops (e.g. VELCRO™) so that a bottom surface of one hinge portion may removably attach to the top surface of another hinge portion via the hook-and-loop attachment. In another example, the spine of the storage device may include spring posts configured to be inserted through holes in the hinge portions of the inserts and secure the inserts.

In another example, a series of inserts may be attached to another in a horizontal and/or vertical manner. For example, multiple inserts may be arranged in a vertical manner with a top end of the top insert attached to a ring or hanger member for attaching to a hook, such as clothes hook. In other examples, each insert may be inserted or stored in a storage device having dividers for separating each insert or may hang and move along rails in a storage device. The inserts may include a cover, such as a transparent cover, for easy visualization of the contents of each insert and further protection of the contents. Furthermore, the system may be portable, e.g. via a removable or non-removable holding strap, handle, wheels, etc. attached to the storage container.

Reference will now be made in detail to the exemplary embodiments of the disclosure, examples of which are illustrated in the accompanying drawings. Wherever possible, the same reference numbers will be used throughout the drawings to refer to the same or like parts.

Figure 2:
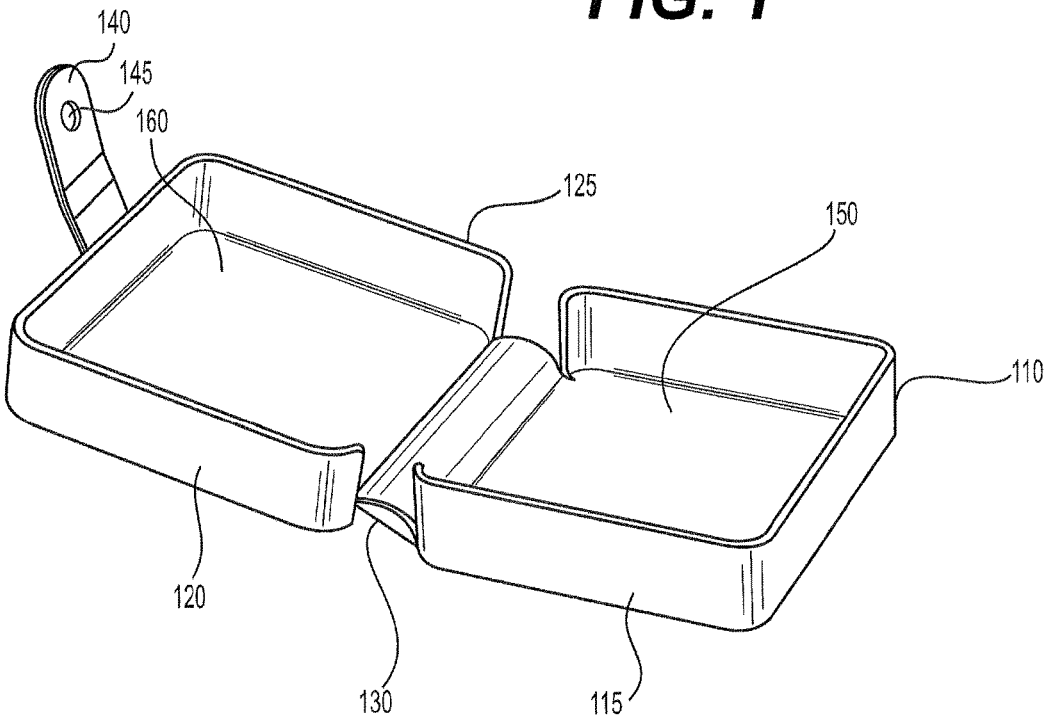
FIG. 2 is a perspective view illustration of the storage device of FIG. 1 in an open configuration.

FIGS. 1 and 2 are perspective views of a device 100 in closed and open configurations respectively. The device 100 may be configured to store one or more inserts. Each insert may hold items on its surface via a holder. The device 100 may include a base member 110, a lid member 120, a spine member 130, and a closure member 140 for removably holding the lid 120 to the base 110.

Portions of the base member 110 and lid member 120 may be connected via the spine member 130. The base member 110 and lid member 120 may each have substantially planar surfaces 150 and 160 having sidewall portions 115 and 125 respectively. The sidewall portions 115 and 125 may extend along one or more portions of the perimeter of each planar surface 150 and 160 of each member 110 and 120. The base member 110 and lid member 120 may have any suitable size and shape such that the lid member 120 may fit over base member 110 to close the device 100. For example, the planar surface 150 of base member 110 may have a smaller size than the planar surface 160 of the lid member 120. In addition, the sidewall portions 115 and 125 may have any suitable size and shape to allow the lid 120 to fit over base member 110.

The spine member 130 may extend between the base member 110 and the lid member 120. For example, the base member 110, spine member 130, and lid member 120 may be formed from a single sheet having sizes suitable for forming each member of the device 100. Alternatively, each member 110, 120, and 130 may be formed using separate components and attached together in any suitable manner e.g. by adhesive, stitching, etc.

The closure member 140 may extend from either the lid member 120 or the base member 110 and may be formed from the same or different material as the member from which it extends. Alternatively, the closure member 140 may be attached, either removably or non-removably, to either the lid member 120 or base member 110 in any suitable manner, such as via stitches, adhesive, staples, buttons, hook-and-loop fasteners, magnetic components, etc.

The closure member 140 extending from either the lid member 120 or base member 110 may attach the base member 110 to the lid member 120 in any suitable manner, such as via one or more attachment portions 145. The attachment portion(s) 145 may include any suitable fastening features, such as a magnet, snap button, hook and loop, button, cord, buckle, etc. (not shown). The lid or base member 120, 110 from which the closure member 140 does not extend, may include a component configured and positioned to attach to the closure member 140. For example, the closure member 140 may extend from the lid member 120 and include a magnetic portion, and the base member 110 may have a metallic component (not shown) positioned to attach to the magnetic portion, of the of the attachment portion 145 of closure member 140 for closing the lid member 120.

One or more of the planar portions 150, 160, sidewall portions 115, 125, spine member 130, and/or closure member 140 may each be manufactured using the any suitable materials, which may include, plastic, wood, leather, cardboard, metal, etc. Each of the components of the storage device 100 may include coatings or surface features, such as protrusions, indentations, etc. For example, an inner surface of the planar member 150 of base member 110 and/or spine member 130 may include portions having attachment features (e.g. VELCRO™) configured to attach to portions of an insert 310, shown in FIG. 3. Various materials having various properties may be used in manufacturing portion of the device 100. For example, outer portions of the device 100 may be water-resistant and may include exterior pocket or pouches which may be closable in any suitable manner, such as via zippers, VELCRO™, and which may be transparent or opaque.

Figure 3:
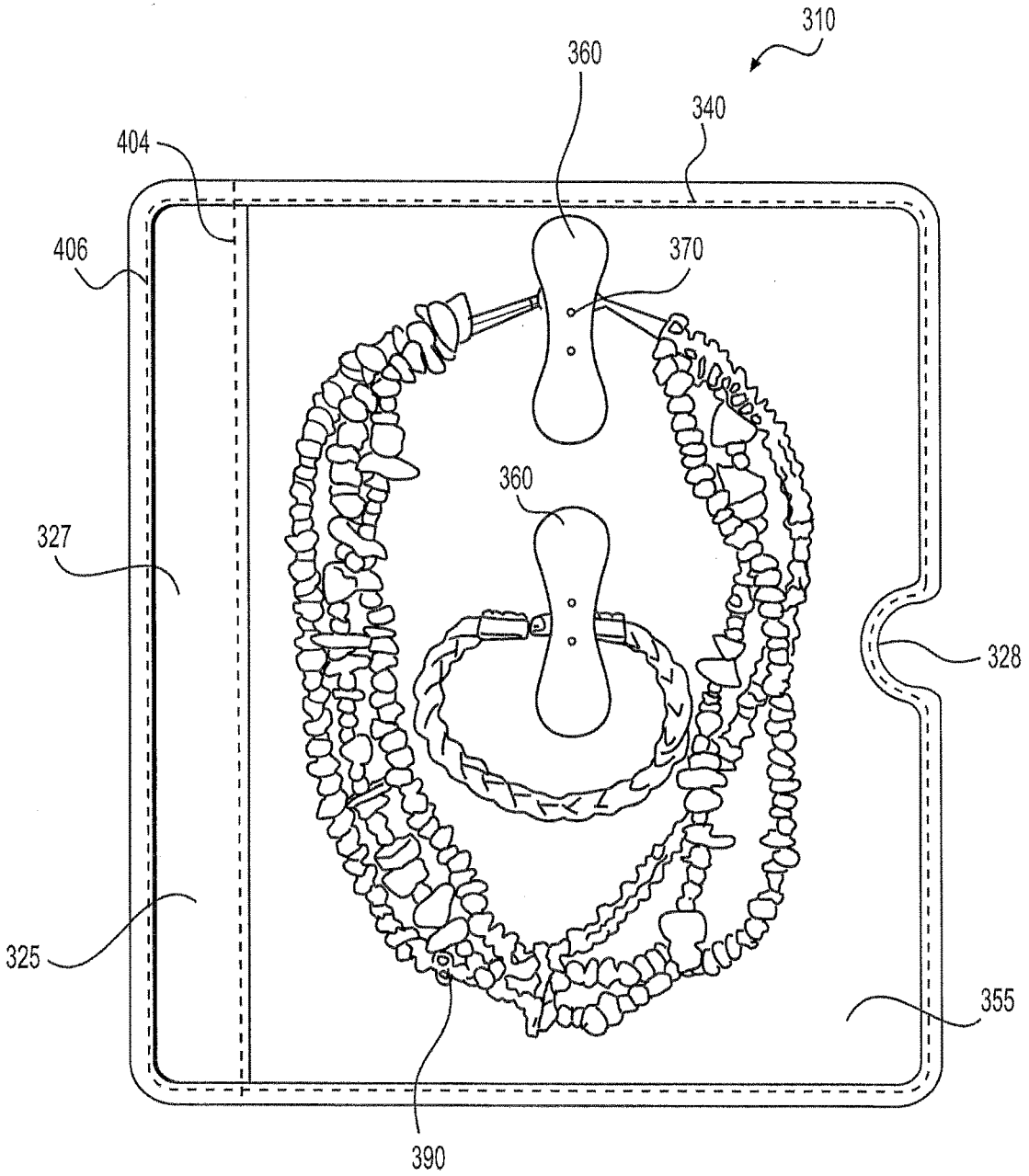
FIG. 3 is a perspective view of an exemplary insert for use with the storage device of FIGS. 1 and 2.

Referring now to FIG. 3, insert 310 may be configured to be disposed securely into the storage device 100. The insert 310 may have any suitable size and/or shape for being disposed in the storage device 110 and for holding objects. The insert 310 may include one or more attachment surfaces 355 and a hinge portion 325 along an inner edge of the insert 310. Each insert 310 may include a single attachment surface 355, or may have front and back attachment surfaces 355. Each attachment surface 355 may include one or more attachment features.

For example, attachment surface 355 may include one or more portions having a plurality of loops for attaching to hook portions in a hook-and-loop type fastening attachment (VELCRO™). In the example shown in FIG. 3, the insert 310 includes a plurality of loops on both of the front and back surfaces for attachment to a holder 360 having a plurality of hooks on a back surface thereof. In another embodiment, the insert 310 may have a quilted configuration in which a portion of the attachment surface may include two layers having edges attached to each other and padding in between the two layers to provide cushioning for further protection of any fragile objects. The padding material may be any suitable material such as cotton wool, feathers, etc. In another embodiment, the insert 310 may include a plurality of strips having loops for attachment to a holder. The strips may be spaced along the insert 310 in any suitable manner, in a uniform or non-uniform manner.

The insert 310 also may include one or more indentations 328 along one or more edges. The indentations 328 may provide easy insertion and removal. The indentations 328 may have any suitable size and shape. For example, the indentations 328 may be curved and sized for easy gripping by between a user's finger and thumb. Similar indentations may be included in cover 610 shown in FIG. 6 and further discussed below.

Figure 10:
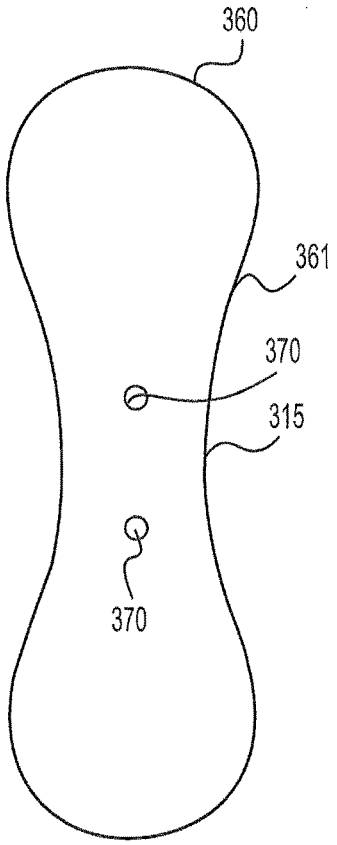
FIG. 10 is a front perspective view of a holder for use with the insert of FIG. 3, according to an exemplary embodiment of the present disclosure.
Figure 11:
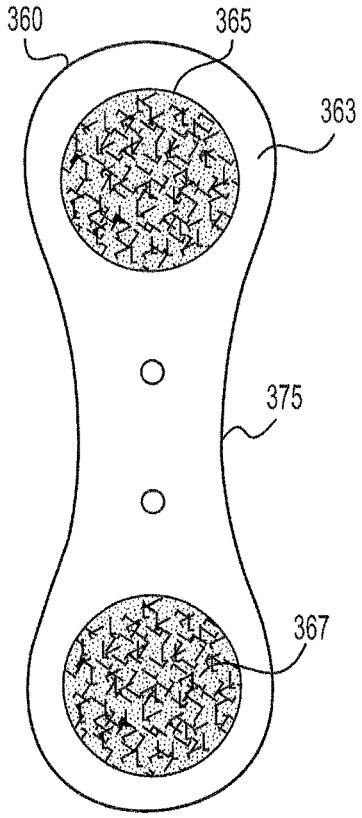
FIG. 11 is a back perspective view of the holder of FIG. 10.

The insert 310 may have any suitable color and may include graphical images or themes and/or borders. The holder 360 is shown in FIGS. 10 and 11 and may have any suitable size, and/or shape for removable attachment to an attachment surface 355 of an insert 310, and for removably holding an item 390, such as jewelry (e.g. necklaces, earrings, rings, bracelets, brooches, cuff links, etc.) on the attachment surface 355 in a secured manner. In the embodiment as shown in FIG. 11, the holder 360 may include a pair of areas 365 and 367 having a plurality of hooks on a back surface 363 for attachment to the plurality of loops on an attachment surface 355 so that the holder 360 may be attached, removed, and re-attached to the attachment surface 355 via a hook-and-loop type attachment. However, as discussed above, any other or additional suitable attachment features may be used in place of a hook and loop type attachment.

In another embodiment, the holder 360 may include a strip (not shown), a portion of which may be attached to the attachment surface 355 via stitching, adhesive, or by any other suitable attachment. The strip may have a plurality of hooks on a back surface 363 for attachment to the plurality of loops on an attachment surface 355 so that the holder 360 may be attached, removed, and re-attached to the attachment surface 355 via a hook-and-loop type attachment. The strips may have any suitable shape, size, and geometry and may be manufactured using a variety of materials. The strips may have elastic properties and multiple strips may be arranged on the attachment surface 355 in any suitable pattern, such as a grid.

In one embodiment, the holder 360 may include a flap having a bottom surface attached to the attachment surface 355 and having one or more female halves of a snap button fastener and a top surface having one or more male halves of the one or more snap button fasteners. In this embodiment, a portion of the item, such as a necklace, may be inserted within the flap and secured by engaging the two halves of the snap button fasteners. The flap may have any suitable shape, geometry, and dimensions, and may be manufactured using a variety of different materials, such as fabric, leather, plastic, etc. The snap button fastener may be circular or have any other suitable shape and may be manufactured using any suitable material or combination of materials, such as metal and/or plastic.

In another embodiment, the holder may include a strap (not shown) having elastic loops on each side configured to removably engage complimentary hooks arranged on opposite sides of the attachment surface. Objects may be placed between the strap and the attachment surface of the insert 355.

The areas 365 and 367 may have the same or a different size and/or shape. Further, it is understood that the entire back surface of the holder may be covered with the attachment features (e.g., hooks), not just areas 365 and 367.

As shown in FIG. 11, the holder 360 may include one or more holes 370 spaced apart from each other and located between the pair of areas 365 and 367 having the hooks. The holes may be any suitable size or shape and may be configured to allow attachment to objects having protrusions or pins, such as earring pins and/or backs, pins, badges, and/or buttons. As shown in the figures, the ends of the holder 360 may be the same shape and larger than a middle portion 375. This configuration may facilitate secure attachment of the holder 360 at the areas 365 and 367 to the attachment surfaces 355 and to contact with and holding of the objects 390 at the middle portions 375. In this manner, the holder 360 may provide an increased surface area at 365 and 367 for secure attachment.

In some embodiments, the holder 360 may include a pouch or a pocket having a back surface with an attachment surface, such as hooks, to attach to the looped attachment surface 355. The pouch or pocket may be translucent and may have any suitable size, shape, and geometry. The pouch or pocket may be manufactured using any suitable materials, such as plastic, or fabric.

Referring back to FIG. 3, the hinge portion 325 of the insert 310 may be attached to the attachment surface 355 to allow the attachment surface 355 to move radially or flex while the hinge portion 325 is stationary and attached in the base member 110. The hinge portion 325 may extend along only a portion, or along an entire inner edge of the attachment surface 310. For example, an inner edge (left edge shown in FIG. 3) of the attachment surface, 355 may be disposed between upper and lower components of the hinge portion 325. The hinge portion 325 may have any size suitable to accommodate various sized and shaped objects 390.

Figure 4:
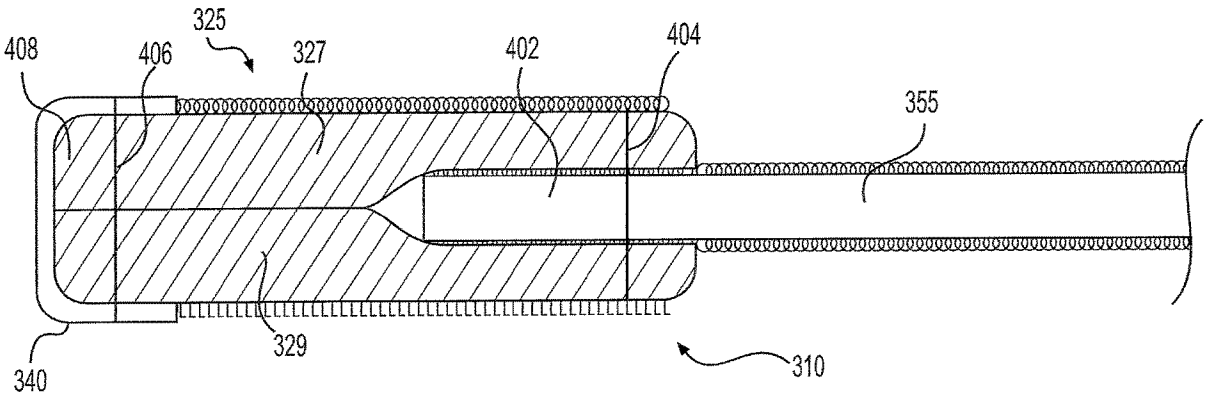
FIG. 4 is a partial side view of the insert of FIG. 3.
Figure 5:
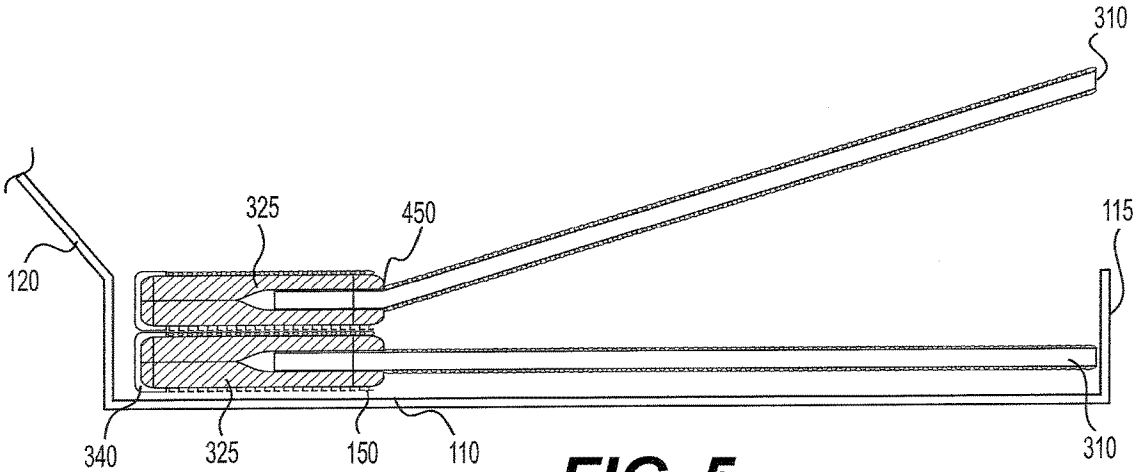
FIG. 5 is a side view of the insert of FIG. 3 with multiple inserts stacked together in a storage device, according to an exemplary embodiment of the present disclosure.

Referring now to FIGS. 4 and 5, which show side views of the insert 310 for insertion into storage device 100 (FIG. 1). As shown in FIGS. 4 and 5, inner edge portion 402 of the attachment surface 355 may be disposed within the hinge portion 325, between a top member 327 and a bottom member 329. The inner edge portion 402 may be non-removably attached within the hinge portion 325 in any suitable manner, such as via stitching 404. An inner edge portion 408 of the hinge portion 325 may in turn be disposed within a border and/or stitching 340 and secured by stitching 406. The hinge portion 325 having top and bottom members 327 and 329 may have any suitable width for accepting an inner edge portion 402 of the attachment surface 355. The top and bottom members 327 and 329 of the hinge portion 325 may have complimentary or the same attachment components (hooks or loops) configured to attach to the opposite surface of the hinge portion 325 of another insert 310. For example, as shown in FIG. 5, the bottom surface of the hinge portion 325 of a first insert 310 may have loops for attachment to the top surface of the hinge portion 325 of a second insert 310 having a hooked surface. In this manner, multiple inserts 310 may be removably attached at an inner edge and allow the inserts 310 to flex at locations 450. The hooked surface of the hinge portion 325 may attach to the inside surface 150 of the base member 110 of the device 100.

The border 340 may extend around the entire insert 310, as shown in FIG. 3, to maintain durability and/or ease of use. Top and bottom surfaces of the insert 310 may have the same attachment features, e.g. either hooks or loops so that adjacent inserts 310 do not stick together. For example, each surface of the inserts may have loops.

Figure 6:
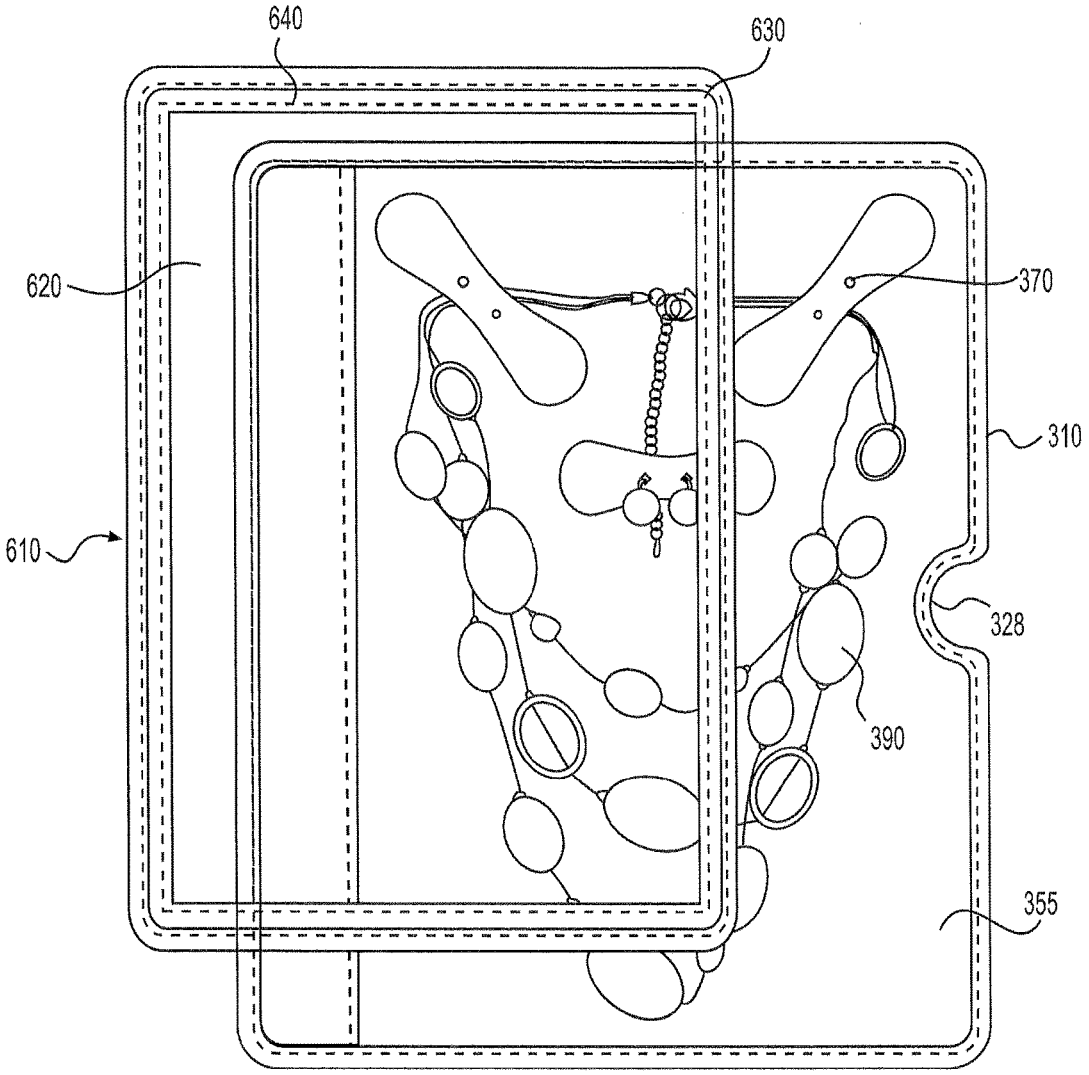
FIG. 6 is a perspective view of the insert of FIG. 3 with a cover member, according to an exemplary embodiment of the present disclosure.

As shown in FIG. 6, the insert 310 may include a cover 610 for protecting and further securing items 390 secured to attachment surface 355. The cover 610 may include a border 630 including an attachment feature on a back surface for attaching to the attachment feature of attachment surface 355. For example, the attachment feature of the attachment surface 355 may include a plurality of loops and the back surface of at least a portion of the border 630 (e.g. an inner portion 640) of cover 610 may include a plurality of hooks for removably attaching to the plurality loops of the attachment surface 355. One or more portions of internal portion 620 of the cover may be clear, translucent, and/or transparent for viewing of the items 390. The cover 610 may have any suitable size and or shape for removable disposal over the attachment surface 355 of the insert 310. For example, the internal portion 620 of the cover 610 may cover the entire area of the attachment surface 355, or less than the entire attachment surface 355, such as half of the attachment surface 355. Cover 610 may be sized to extend to, but not cover, the hinge portion 325. The cover 610 also may have any suitable properties to allow identification and/or protection of the items. For example, the cover may be rigid, air filtering, light filtering, waterproof, tinted, wipeable, etc.

Figure 7:
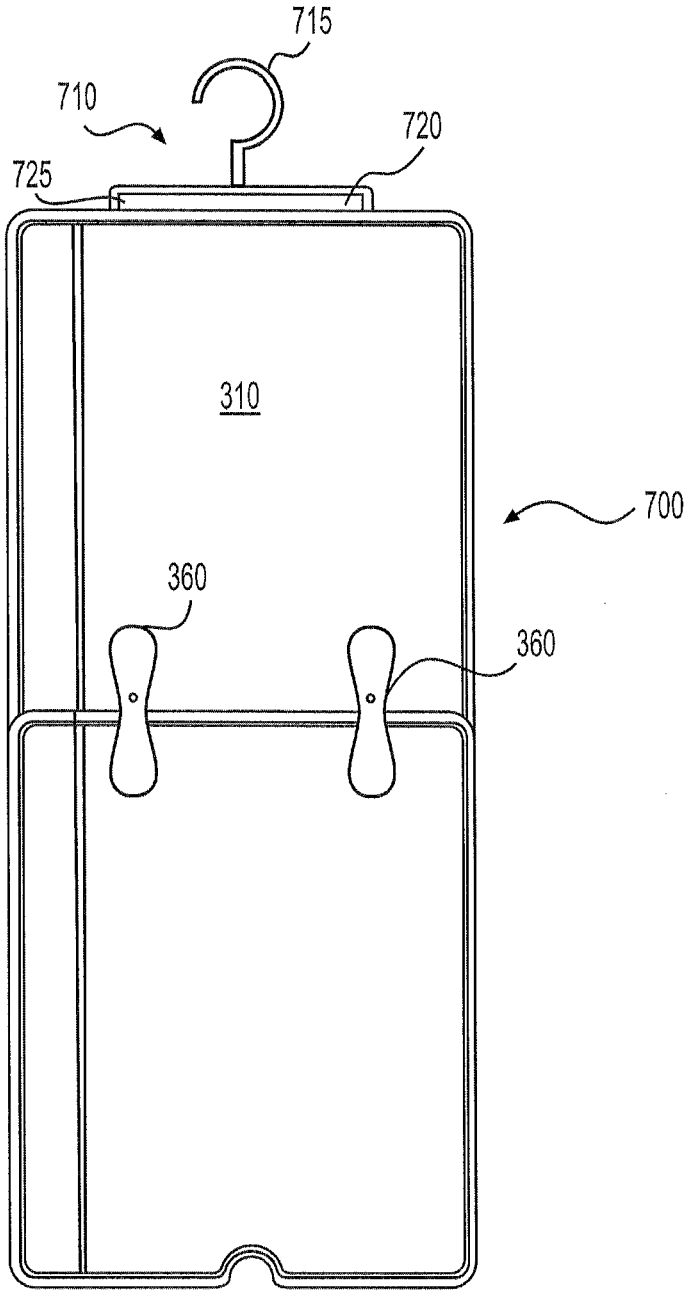
FIG. 7 is a perspective illustration of the use of multiple inserts according to another exemplary embodiment of the present disclosure.

FIG. 7 shows a system 700 having one or more inserts 310 connected together via holders 360 and a hanging member 710. Hanging member 710 may include a ring member 715 and an attachment strip 720 having an attachment surface 725 for attaching to a portion of the insert 310. The attachment surface 725 may have any suitable attachment features, such a plurality of hooks for attaching to a plurality of loops on a portion of the insertion 310. The ring member 715 may be configured to attach to a protrusion or hook, such as a door hook. The attachment strip 720 may be configured to be removably attached to a surface portion of the insert 310, such as a back surface. Holders 360 may be used to connect multiple inserts 310 in a vertical hanging fashion.

Figure 8A:
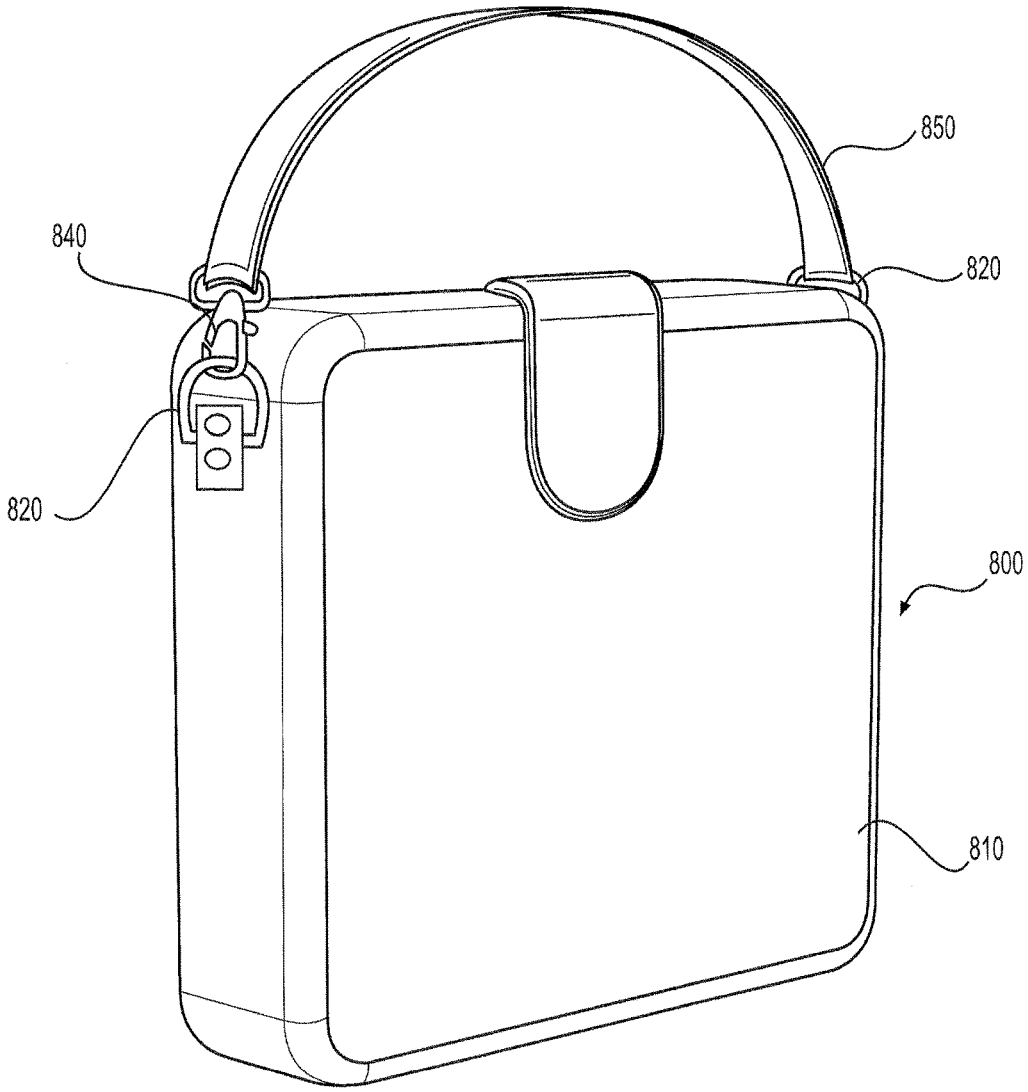
FIG. 8A is a perspective view illustration of another embodiment of the device in a closed configuration, according to an exemplary embodiment of the present disclosure.

FIG. 8A shows an apparatus 800 having a device 810 similar in most aspects to device 100 and including a removable strap member 850 connected to external surfaces of the device 810 via one or more fasteners 840 and clips 820 for use in carrying the device 810. The strap member 850 may have any suitable shape and its size may be adjusted. In some embodiments, the deice 810 may include multiple strap members 850, for example for carrying the device 810 on the user's back. The strap member also may be connected to a single side of the device 810 and may allow the device to be pulled via the strap member 850. In such an example, the device 810 may include wheels, rollers, or other features configured for moving the device 810 along a surface.

Figure 8B:
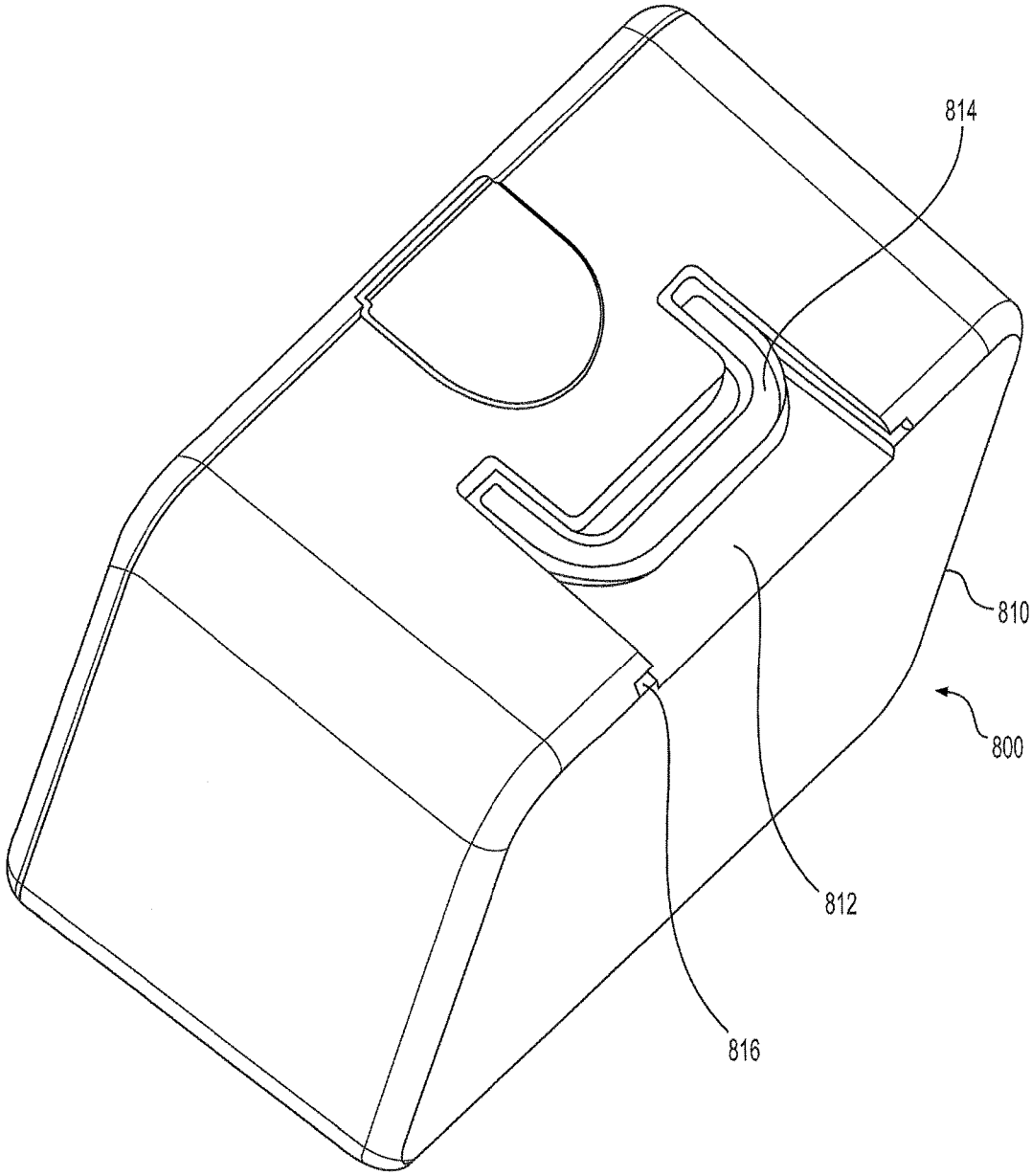
FIG. 8B is a perspective view illustration of another embodiment of the device in a closed configuration, according to an exemplary embodiment of the present disclosure.

FIG. 8B shows another example of apparatus 800 having a removable handle 814 on device 810. A top portion of the device 810 may include a sunken portion 812 having slots 816 on sidewalls of the sunken portion 812. The handle 814 may include sliding members (not shown) configured to slide within the slots 816 and across a surface of the sunken portion 812 to adjust the position of the handle 812. The handle 814 may be pivoted via the sliding members to protrude from the sunken portion 812 and be held by a user. The slots 816 may have any suitable size and shape. For example, internal end portion of the slots 816 may have a smaller size than the opposite end portion of the slots 816 to secure or lock the sliding members of the handle 814 to the device 810. The handle 814 may be configured to be slidingly removed from the device 810 via the slots 816.

Figure 9A:
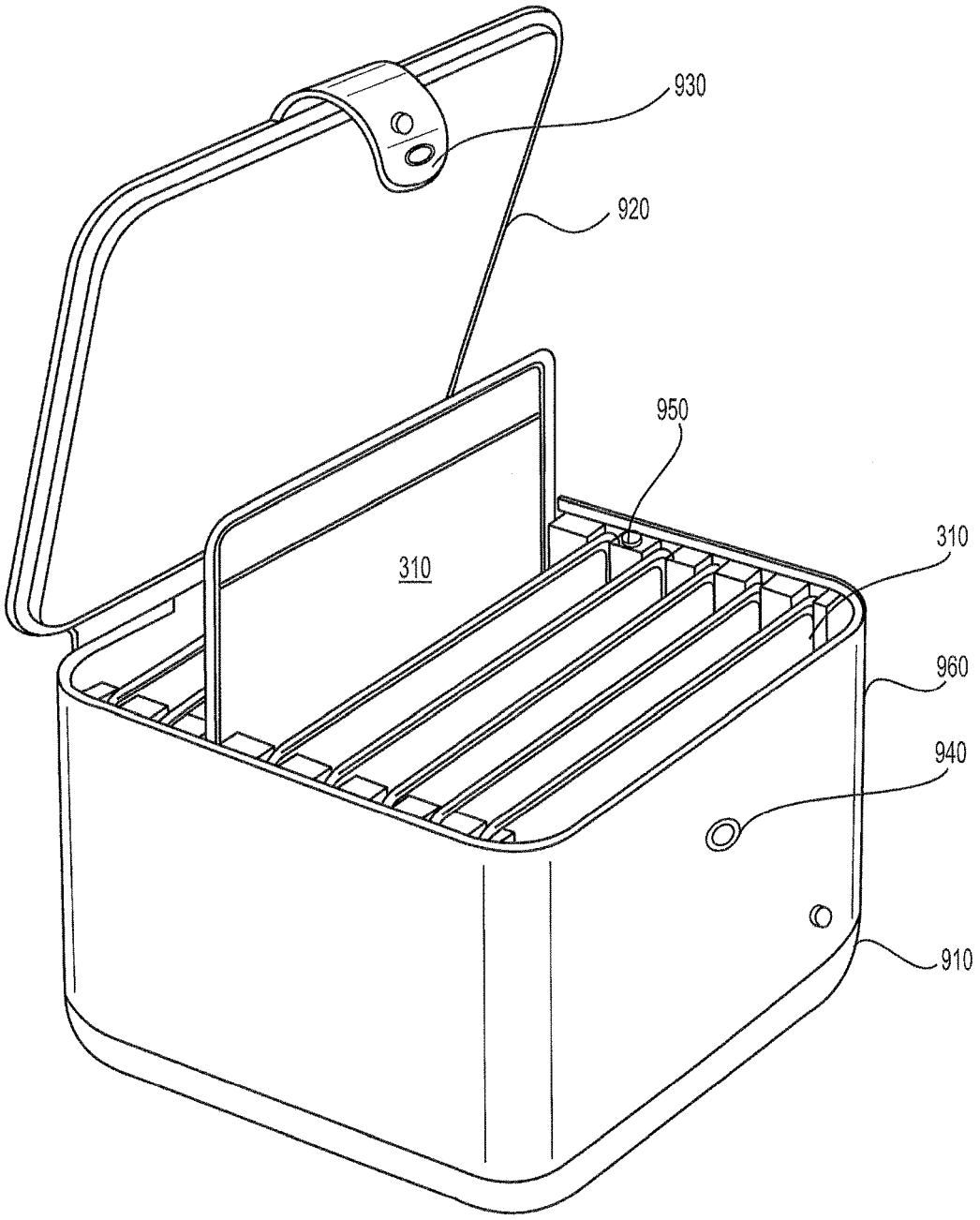
FIG. 9A is a perspective view illustration of yet another embodiment of the device in an open configuration, according to an exemplary embodiment of the present disclosure.

FIG. 9A shows a storage system 910 for holding multiple inserts 310. The system 910 may include a base member 960 a lid member 920, and closure members 920 and 930 similar to the closure member 140. In addition, the device 910 may include dividers 950 having any suitable size and/or shape spaced apart from each other to allow housing of the inserts 310 between two divider 950. The dividers 950 may be disposed along two opposite sides of the inside surfaces of the device 950 and may be manufactured in any suitable manner, e.g. plastic molding. The dividers may 950 may be color-coded and may allow labeling. The inserts 310 may include tab portions or other protrusions or indentations along an edge portion for allowing the insert to be easily grasped. The storage system 910 also may include strap members similar to the configuration shown in FIG. 8, wheels, and/or any other features for allowing portability as well as a closure member 930 similar to the closure member 140 in FIG. 1.

Figure 9B:
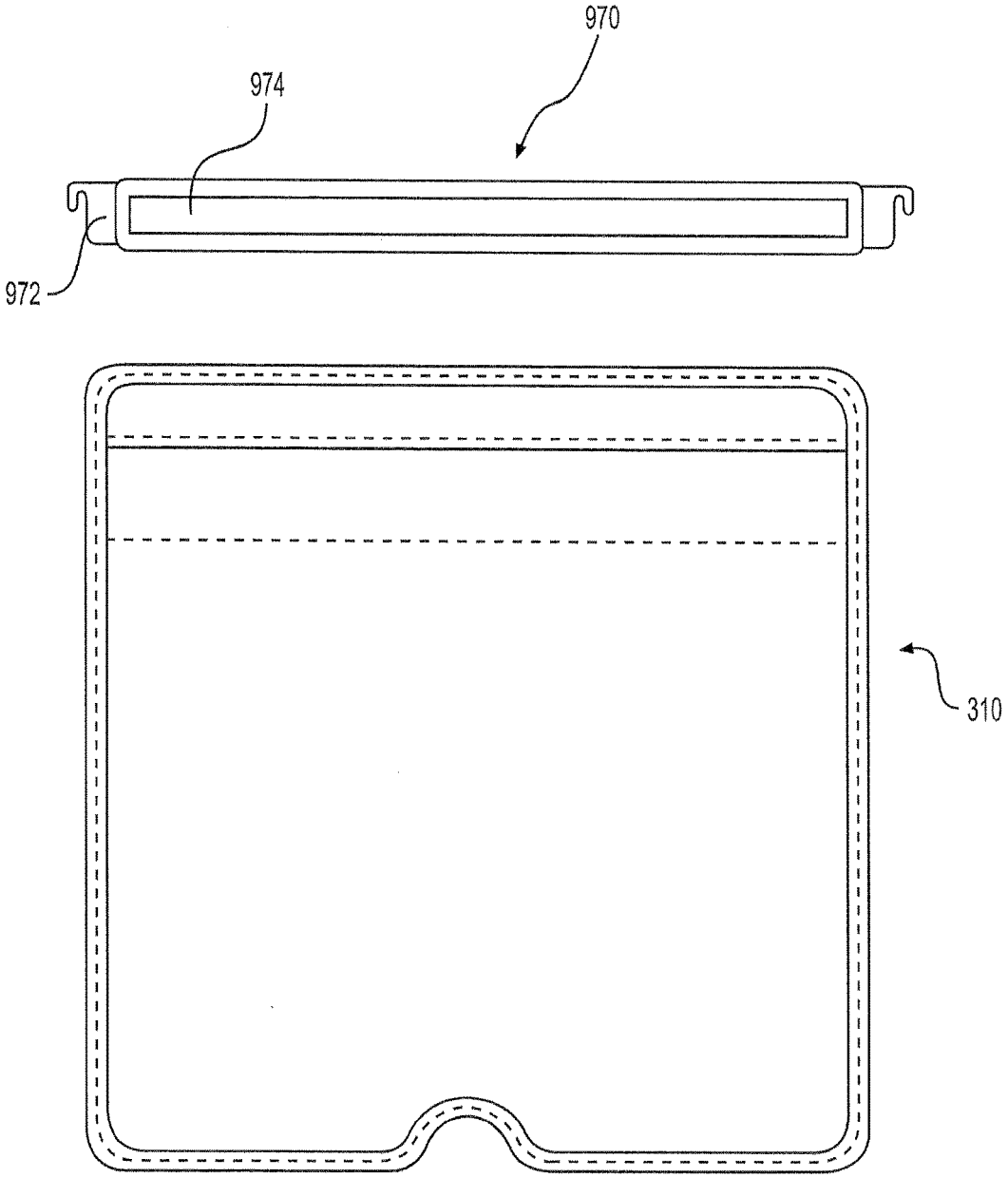
FIG. 9B is a perspective view of an exemplary insert for use with a storage device.

FIG. 9B shows a hanging member 970 configured to attach to insert member 310 in alternative storage system to storage system 910. The hanging member 970 may include an attachment portion 974 having similar attachment features as described above, such as hook and loop features, for attaching to a portion of the insert member 310. Each side end of the hanging member 970 may include hooks ends 972 configured to engage and slide along rails positioned in a device. In some examples, the attachment portion 974 may separate the two hook ends of the hanging member 970 and removably attach to a surface of a top portion (such as top member 327 shown in FIG. 3) of the insert member 310 in any suitable manner, e.g. via a hook and loop attachment. The hook ends 972 may each be configured to slide along two rail members (not shown) which may be disposed along two opposite sides of a storage system. The hook ends 972 may engage the rail members and slide along the rail members so as to allow a user to identify and assess the contents of multiple insert members 310 stored in the storage system 910.

The device and systems described herein provide secure and organized storage of fragile objects. In particular, the above described devices and systems allows a user to organize objects on one or more inserts 310 according to various characteristics of the object (e.g. color, type (rings, necklaces, gold, pearls, silver), event (formal, casual), etc.), as well as provide easy visualization and quick access to the objects. Such access can be in form of a binder or book type pages with multiple inserts 310 stacked in the storage device 100. The hinge portion 325 of such a binder type configuration of inserts 310 may include spring post binding (not shown) allowing multiple inserts 310 to be added to the binder. In this binder configuration, each insert may include holes of into which the spring posts may be inserted. The spring posts may have a base including a spring configured to allow the post to bend in any direction. The spring posts may have any suitable size, shape, and geometry. The holes may be formed on an edge of the insert or may be formed in one or more tabs having a hinge and attached to the edge of the insert 310.

Each insert 310 also may include a stand portion for configuring the insert 310 in an easel configuration. The device and systems may be stored and be stationary and can be taken while travelling, as such solve the problem of going from storage directly to travel using a single device or system.

While principles of the present disclosure are described herein with reference to illustrative embodiments for particular applications, it should be understood that the disclosure is not limited thereto. Those having ordinary skill in the art and access to the teachings provided herein will recognize additional modifications, applications, embodiments, and substitution of equivalents all fall within the scope of the embodiments described herein. Accordingly, the invention is not to be considered as limited by the foregoing description.

We claim:

1. A system for storing items, comprising:

a storage device having a base portion and a lid portion;

one or more movable inserts configured for disposal in the storage device, the one or more inserts having a surface comprising one or more first fastening elements; and a holder configured to be removably attached to a insert, the holder having a surface comprising one or more second fastening elements configured to engage the one or more first fastening elements, and configured to hold the items on the surface of the insert, wherein the storage device further comprises a plurality of slots formed inside two opposite sides of the base portion and configured to hold one of the one or more inserts.

2. The system of claim 1, wherein the one or more inserts includes a hinge portion configured to attach to the hinge portion of another one of the one or more inserts.

3. The system of claim 2, wherein the first and second fastening elements form a VELCRO™ connection.

4. The system of claim 1, further comprising a cover member removably attached to a portion of the surface of the one or more inserts.

5. The system of claim 4, wherein the cover member is transparent.

6. The system of claim 1, wherein the holder comprises a middle portion between two end portions, the middle portion having a width smaller than the width of the end portions.

7. The system of claim 6, wherein the holder comprises one or more holes.

8. The system of claim 7, wherein the one or more holes are located in the middle portion of the holder.

9. The system of claim 1, wherein the system includes a plurality of holders, the holders being configured to secure two inserts vertically together.

10. The system of claim 1, wherein the base portion has a depth greater than or equal to a width of the one or more inserts.

11. The system of claim 1, further comprising a handle member connected to an external surface of the base portion or an external surface of the lid portion.

12. An insert configured for housing in a storage device, comprising:

a hinge portion configured to be removably attached to a hinge portion of another insert, an attachment surface having an edge disposed within a top and bottom surface of the hinge portion, the attachment surface having a first surface and a second surface comprising one or more fastening elements; and a handing member comprising a ring member configured to attach to a protrusion and a fastening element configured to removably attach to the attachment surface.

* * * * *